US009499932B2

(12) United States Patent
Seikel et al.

(10) Patent No.: US 9,499,932 B2
(45) Date of Patent: Nov. 22, 2016

(54) DETERGENT DRAWER

(71) Applicant: PAS Deutschland GmbH, Neuruppin (DE)

(72) Inventors: Michael Seikel, Berlin (DE); Roland Meyer, Bernau/OT Bornicke (DE); Marek Klimecki, Poznan (PL); Michael Westphal, Ahrensfelde (DE)

(73) Assignee: PAS Deutschland GmbH, Neuruppin (DE)

( * ) Notice: Subject to any disclaimer, the term of this patent is extended or adjusted under 35 U.S.C. 154(b) by 220 days.

(21) Appl. No.: 14/084,778

(22) Filed: Nov. 20, 2013

(65) Prior Publication Data

US 2014/0137608 A1 May 22, 2014

(30) Foreign Application Priority Data

Nov. 20, 2012 (DE) ..... 20 2012 104 492 U

(51) Int. Cl.
*D06F 39/02* (2006.01)

(52) U.S. Cl.
CPC ..... *D06F 39/02* (2013.01)

(58) Field of Classification Search
CPC ..... D06F 39/02; A47B 2200/0034; A47B 2088/0433; A47B 2088/0444; A47B 2088/0437
USPC ..... 68/17 R
See application file for complete search history.

(56) References Cited

U.S. PATENT DOCUMENTS

| | | | |
|---|---|---|---|
| 2,548,533 | A | 4/1951 | Hendricks |
| 3,024,075 | A | 3/1962 | Howe |
| 5,161,870 | A | 11/1992 | Mason et al. |
| 2009/0261697 | A1 | 10/2009 | Hill et al. |

FOREIGN PATENT DOCUMENTS

| | | |
|---|---|---|
| DE | 3404293 | 8/1985 |
| DE | 19825324 | 12/1999 |
| DE | 10355671 | 6/2004 |
| DE | 202006019468 | 3/2007 |
| DE | 102008014871 | 9/2009 |
| DE | 102010061097 | 6/2011 |

(Continued)

OTHER PUBLICATIONS

Partial European Search Report for corresponding European Application No. 13192547.1, mailed Feb. 27, 2014.

(Continued)

*Primary Examiner* — Michael Barr
*Assistant Examiner* — Rita Adhlakha
(74) *Attorney, Agent, or Firm* — Jason H. Vick; Sheridan Ross, PC

(57) ABSTRACT

According to one aspect a detergent drawer for a washing machine is disclosed, the detergent drawer comprising a linear guiding, a first holder for a detergent container, a second holder for a front plate and a front plate arranged at the second holder, wherein the linear guiding provides a displacement of a movable portion of the detergent drawer relatively to the washing machine and at least approximately perpendicular to an operating panel of the washing machine in a direction of motion, wherein the detergent drawer has a driving mechanism configured to automatically open the detergent drawer using a mechanically generated force when a user applies a pushing force to the front plate and then releases the front plate.

14 Claims, 12 Drawing Sheets

(56) References Cited

FOREIGN PATENT DOCUMENTS

| | | |
|---|---|---|
| EP | 1403415 | 3/2004 |
| EP | 1905881 | 4/2008 |
| EP | 2003237 | 12/2008 |
| EP | 2281938 | 2/2011 |
| ES | 2301316 | 6/2008 |
| GB | 2089842 | 6/1982 |

OTHER PUBLICATIONS

European Search Report for corresponding European Application No. 13192547.1, mailed May 14, 2014.

DETERGENT DRAWER

CROSS REFERENCES TO RELATED APPLICATIONS

This application claims priority from German utility model DE 20 2012 104 492.7, filed on Nov. 20, 2012. The entire contents of this priority application is incorporated herein by reference.

BACKGROUND OF THE INVENTION

The present application relates to a detergent drawer for a washing machine, and in particular to a detergent drawer comprising a linear guiding, a first holder for a detergent container, a second holder for a front plate, wherein the linear guiding provides a displacement of a movable portion of the detergent drawer relatively to the washing machine and at least approximately perpendicular to an operating panel of the washing machine in a direction of motion. The present application further relates to a washing machine with a detergent drawer.

In most of the front loader washing machines, the detergent and/or the softener is provided via a detergent drawer. A movable portion of the detergent drawer is pulled out with the help of a shell-like handle fixed to the drawer for filling and is manually pushed back into the washing machine after filling.

Today's detergent drawers convey however an impression of a lesser quality, e.g. because the motion of the movable portion is subject to slackness, because pulling out the movable portion is sensed as arduous or a lighting at the movable portion is lacking due to technical difficulties.

SUMMARY OF THE INVENTION

It is therefore an object to provide a technically improved detergent drawer that conveys the user a comfortable and high-quality impression.

According to a first aspect, there is provided a detergent drawer for a washing machine, the detergent drawer comprising a linear guiding, a first holder for a detergent container, a second holder for a front plate, wherein the linear guiding provides a displacement of a movable portion of the detergent drawer relatively to the washing machine and at least approximately perpendicular to an operating panel of the washing machine in a direction of motion, wherein the linear guiding comprises at least one longish guiding element, that is arranged in a guiding sleeve and being guided herein, wherein the guiding sleeve is configured to be fixedly connected to the washing machine.

The use of a linear guiding with at least one longish guiding element that is arranged in a guiding sleeve reduces the slackness of the movable portion and prevents an excessive rattling when pulling out the movable portion. Furthermore, the friction in pulling out and pushing in the detergent drawer can be kept small by an appropriate combination of guiding element and guiding sleeve.

It should be noted in this context that within the context of the disclosure the term "movable portion" describes the portion of detergent drawer that the user pulls out from the washing machine for filling with detergent and/or softener and pushes back in. The movement of the movable portion may also be, at least partially, performed by the driving mechanism. This means in particular that the movable portion may be understood, without being limited to, as a detergent box, as a push box or as a detergent container. The movable portion includes furthermore such mounting parts, that move with the detergent box, the push box or the detergent container when pulling these out. Further, the term "front plate" encompasses a "shell-like handle", as will be shown in FIGS. 19 and 23, as well as a "front cover", as will be shown in FIG. 2.

The term of direction of motion should be understood as those directions, along which the movable portion of the detergent drawer is pulled out or moved out for filling and pushed back in after the filling.

The first holders are preferably embodied integrally as one piece. In particular, the first holder can be provided at a first side of a common element and the second holder at a second side of the common element.

In a refinement the guiding element extends in the direction of motion with a substantially constant cross section.

This refinement is particularly easy to realize. It is particularly advantageous if the guiding element has an oval, an ellipsoidal or a circular cross section.

In another refinement the detergent drawer comprises a drive unit, that is configured to drive by motor the movable portion of the detergent drawer in the direction of motion or to support its motion.

By touching the detergent drawer or by actuating a separate key, starting from a closed state of the detergent drawer, the drive unit is actuated and thus the movable portion is driven out. After the user has filled the detergent container, the movable portion can be driven back in by a second touch or by pressing a key again.

In a refinement the drive unit comprises a toothed rack that is fixedly connected to the movable portion of the detergent drawer, and a motor with a gearwheel, wherein the gearwheel engages the toothed rack and the motor is configured to be fixedly connected to the washing machine.

This refinement enables a particularly good and exact motor-driven motion or support of the detergent drawer.

According to a second aspect, which in itself presents a further development over the prior art (i.e., even without the previously mentioned at least one longish guiding element and the guiding sleeve), but also can be combined with one or more of the previously mentioned aspects, the detergent drawer comprises a detergent container, that is arranged at the first holder, wherein the detergent drawer and the first holder comprise a two-piece coupling assembly, that is configured to detachably and form-fittingly couple the detergent container and the first holder with each other.

This refinement presents a particularly advantageous connection between the first holder and the detergent container.

The connection between the first holder and the detergent container is easy to detach, e.g. for separately cleaning it in a dish washer. While the prior art suggests an interlocking connection with a plurality of interlocking elements, that are difficult to detach and only with significant force, the coupling assembly in two pieces enables an easy and comfortable detaching of the detergent container from the first holder.

In another refinement the coupling assembly is configured at least similar to a bayonet connection.

This refinement will be illustrated later in the context of a preferred embodiment.

In another refinement a first part of the coupling assembly is fixedly arranged at the detergent container, and a second part of the coupling assembly is rotatable around a rotation axis along the direction of motion, in order to couple the first and the second part with each other, and the parts of the coupling assembly group are formed so that in the coupled state a detaching is prevented.

The portions are configured so that one of the portions in a certain rotational position can be pushed over the other portion in a push direction, while it prevents a motion back in the push direction in a second rotation position. Preferably, the second portion of the coupling assembly comprises a protrusion that makes it easier for the user to rotate the second portion around its rotational axis.

According to a third aspect, which in itself presents a further development over the prior art (i.e., even without the previously mentioned at least one longish guiding element and the guiding sleeve), but also can be combined with one or more of the previously mentioned aspects, the detergent drawer comprises an energy storage device at a portion of the detergent drawer that is movable in the direction of motion and a two-piece transmission assembly, that comprises a first electric part and a second electric part and is configured to transfer electric energy wirelessly from the first part to the second part, wherein the first electric part is arranged at the detergent drawer and electrically connected with the energy storage device and the second electric part is configured to be fixedly arranged at the washing machine.

This refinement enables in an easy way to arrange an energy storage device in the movable portion of the detergent drawer and to supply it by a simple design with electric energy. The energy storage device provides preferably electric energy for lighting the movable portion, in particular of the shell-like handle or of a front cover. When the detergent drawer is closed, the first electric part and the second electric part are located close to each other. They can preferably engage each other. In this position the electric energy is transferred from the first part to the second part and from there to the energy storage device. The energy storage device then supplies e.g. a lighting device. If the detergent drawer is opened, it can come to an interruption between the first and the second electric part. The energy storage device can, however, further provide energy, so that e.g. a lighting of the shell-like handle or of the front cover is ensured even without an electric connection between the first and the second electric part.

In another refinement the first electric part and the second electric part each comprise a coil.

This refinement enables a particularly advantageous transfer of the electric energy by induction. It is in particular advantageous, when the first electric part and the second electric part are configured such that the coil of the one electric part comes to rest within the coil of the other electric part, when the detergent drawer is closed.

According to a fourth aspect, which in itself presents a further development over the prior art (i.e., even without the previously mentioned at least one longish guiding element and the guiding sleeve), but also can be combined with one or more of the previously mentioned aspects, the detergent drawer comprises a shell-like handle or a front cover, that is pivotable around a pivoting point at a portion of the detergent drawer movable in the direction of motion at the detergent drawer, when the shell-like handle or the front cover is not interlocked with the detergent drawer, wherein the detergent drawer comprises an interlocking assembly with a first interlocking part and a second interlocking part and the two interlocking parts are configured to interlock with each other, when the shell-like handle or the front cover lies at least sectionally against the detergent drawer in a motion around the pivoting point.

The interlocking connection provided by means of the interlocking assembly can very easily and comfortably be detached by the consumer for cleaning purposes. It is preferred to unlock only one central interlocking position that is very well accessible. The shell-like handle or the front cover can be detached from the detergent drawer by pressing a finger onto the interlocking assembly group.

Preferably, the pivoting point is chosen in one upper section of the detergent drawer and the interlocking assembly is arranged in a lower section of the detergent drawer. Due to the positions being then widely spaced apart from each other very small tolerances at the plastic parts can be realized. In this way the connection has little slackness, this means that the perception of rattling between the individual parts is minimized and the high valued overall impression of the device remains.

In a refinement the first interlocking part is an interlocking nose, that is configured to be resilient in a direction of the pivoting point, and the second interlocking part, is a recess which the first interlocking part engages.

This refinement will be explained in the context of a preferred embodiment. Due to this interlocking and the resilient configuration, a balancing of tolerance is provided and a slackness and rattling between the shell-like handle or front cover, respectively, and the detergent drawer can be avoided.

According to a fifth aspect, which in itself presents a further development over the prior art (i.e., even without the previously mentioned at least one longish guiding element and the guiding sleeve), but also can be combined with one or more of the previously mentioned aspects, the detergent drawer comprises a housing part, at which a control lever is arranged, that comprises a sliding track for a sliding control, and a movable portion of the detergent drawer comprises a sliding pin, that is configured to engage the sliding track and to displace itself along the sliding track, wherein the housing part is configured to be fixedly connected with the washing machine.

This refinement enables a particularly comfortable opening or closing, in particular opening and closing, of the detergent drawer. This will be illustrated in the context of a preferred embodiment. In particular, an autonomous opening of the detergent drawer is activated after a short press onto the shell-like handle or the front cover, respectively, of the closed detergent drawer and the detergent drawer, preferably being damped, is pushed out into an end position. After the filling with detergent the movable portion of the detergent drawer is manually pushed in slightly beyond the end position and remains in the closed state.

It is preferred that a tensioning element, in particular a spring element, preferably a pull-spring, is arranged between a static portion of the detergent drawer and the movable portion of the detergent drawer.

It is further preferred, when the movable portion of the detergent drawer is coupled with a rotary brake in this refinement or in any of the other refinements disclosed here. In particular a toothed rack that engages a fixedly arranged braking rotational element can be provided at the movable portion for this purpose.

In another refinement the sliding track comprises two different levels, that are configured to ensure unidirectional motion of the sliding pin along the sliding track.

In this context it is preferred in particular that the sliding pin enters the sliding track at a first level without a mechanical stress against the control lever and exits the sliding track at a second level with a mechanical stress against the control lever. The mechanical stress disappears abruptly when exiting the sliding track. It is thereby avoided that the sliding pin can enter the sliding track again at the second level. The transition between the first and the second level along the sliding track is provided preferably via an oblique plane.

In another refinement the cooperation between the sliding pin and the sliding track is provided so that the sliding pin enters into the sliding track, when the detergent drawer moves towards the closed position, rests in a curve of the sliding track in the closed resting state of the detergent drawer and blocks an opening of the detergent drawer, and exits from the sliding track when opening the detergent drawer.

A corresponding refinement of the control lever will be more closely explained in more detail in the context of a preferred embodiment.

According to a sixth aspect, which in itself presents a further development over the prior art (i.e., without the previously mentioned at least one longish guiding element and the guiding sleeve), but also can be combined with one or more of the previously mentioned aspects, the detergent drawer comprises a housing part, that has a ramp element, an actuating mechanism displaceable in the direction of motion and a locking element, wherein the locking element is configured to lock a portion of the detergent drawer movable relative to the housing part with the actuating mechanism and to detach it, when the locking element goes onto the ramp element when moving out the movable portion, wherein the actuating mechanism comprises a tensioning element, that is configured to provide a force into the direction of motion between the housing part and the movable portion in the tensioned state, a portion of the tensioning element is arranged at the actuating mechanism and the housing part is configured to be fixedly connected with the washing machine.

This refinement enables that the movable portion of the detergent drawer is locked with the actuating mechanism for a certain path of the motion, so that the actuating mechanism can support the movable portion in its motion through the effects of the tensioning element or move autonomously.

Towards the end of the motion based on the action of the tensioning element or when the motion of the movable portion is advanced under the influence of the user, the locking element slides onto the ramp element and detaches the movable portion from the actuating mechanism. Thereby the movable portion can be taken out, in particular completely, from the detergent drawer.

In the opposite case the movable portion is placed in the detergent drawer. When pushing in the movable portion the locking element glides from the ramp element down and locks the actuating mechanism with the movable portion of the detergent drawer.

In another refinement the movable portion of the detergent drawer comprises a protrusion that can engage a recess in the locking element, and the recess is lifted when going onto the ramp element such that the protrusion is released.

This refinement will be explained in the context of a preferred embodiment. It is further preferred, that the recess is lowered when gliding down from the ramp element, such that protrusion and recess couple with each other in a form-fit manner.

According to a seventh aspect, which in itself presents a further development over the prior art (i.e., without the previously mentioned at least one longish guiding element and the guiding sleeve), but can be combined with one or more of the previously mentioned aspects, the detergent drawer comprises a housing part, a control mechanism displaceable in the direction of motion and a tensioning element, wherein the tensioning element is configured to provide in the tensioned state a force approximately in the direction of motion between the housing part and a part of the detergent drawer movable relative to the housing part, wherein the control mechanism comprises a pivotable locking lever, the movable portion comprises a guiding pin and the housing part comprises a locking pin, wherein the locking lever is configured and arranged such that the locking lever receives in the guiding pin in a first position along the direction of motion and releases the guiding pin in a second position along the direction of motion and receives the locking pin, wherein the housing part is configured to be fixedly connected with the washing machine.

This refinement enables an automatic closing of the movable portion of the detergent drawer, wherein there is no limit in pulling out the movable portion and even taking out of the movable portion is still possible. The functional principle is as follows.

When pulling out the movable portion of the detergent drawer, the movable portion, the control mechanism and the locking lever displace themselves, wherein the tensioning element is tensioned. At the end of a predetermined path of motion, the locking lever displaces itself, in particular rotates, so that it can release the guiding pin of the movable portion and fixes itself detachably to the locking pin. If needed, the movable portion can now be pulled out further or can even be taken out.

In the opposite direction the guiding pin glides into the locking lever, is detachably fixed relatively to the locking lever and displaces the locking lever back into its original position. The locking lever detaches itself thereby from the locking pin. The tensioned tensioning element now pulls the movable portion, the control mechanism and the locking lever back into the resting position.

In another refinement the locking lever has at least approximately an S-shape, wherein the guiding pin is received by a first portion of the S-shape and the locking pin is received by a second portion of the S-shape.

This cooperation will be more closely explained in the context of a preferred embodiment.

In another refinement a portion of the tensioning element is arranged at a steering point at the locking lever so that the steering point rotates around the guiding pin during the release of the guiding pin and thereby displaces the steering point approximately transversely to the direction of motion.

This refinement enables a particularly stable position, when the movable portion of the detergent drawer is pulled out or moved out and the locking lever has received the locking pin. The tensioning element now laterally displaced, ensures that the locking lever holds its position safely and displaces itself only when, in order to release the locking pin, the guiding pin enters the other section of the locking lever.

According to an eighth aspect, which can be combined with one or more of the previously mentioned aspects, there is provided a detergent drawer for a washing machine, the detergent drawer comprising a linear guiding, a first holder for a detergent container, a second holder for a front cover and a front cover arranged at the second holder, wherein the linear guiding provides a displacement of a movable portion of the detergent drawer relatively to the washing machine and at least approximately perpendicular to an operating panel of the washing machine in a direction of motion and wherein the detergent drawer has an driving mechanism configured to automatically open the detergent drawer using a mechanically generated force, when a user applies a pushing force to the front plate in a closed state of the detergent drawer and then releases the front plate.

Such a detergent drawer may allow to omit an opening in the front cover, such opening configured to receive at least one finger of a user's hand and such opening required so that a user can apply a pulling force for pulling out the detergent drawer. The front cover may therefore be embodied with a substantially flat surface and/or without recesses and/or without openings. This may ease the manufacturing of the front cover and makes it easier to keep the front cover clean. One exemplary front cover will be shown in FIG. 2.

Such detergent drawer may also allow to omit a device that provides an electrically generated force, in particular an electric motor, for opening the detergent drawer. This may reduce manufacturing costs and improve the reliability of the driving mechanism.

In a refinement, the front cover is embodied as a substantially flat surface. In a refinement, the driving mechanism has no electrical driving device, in particular no electric motor. In a refinement, the driving mechanism is configured to unlock the detergent drawer when a user applies a pushing force to the front cover and to drive the detergent drawer into an opened state without requiring a force applied by the user. In a refinement, the driving mechanism is configured to lock the detergent drawer when the user has pushed the detergent drawer into a closed state. In a refinement, the driving mechanism comprises the actuating mechanism described in the context of FIGS. 27-28 and/or the control lever described in the context of FIGS. 11-16.

It is pointed out that the features disclosed in the context of at least one of the fifth, sixth and seventh aspect may be preferably combined with the eighth aspect. It is further pointed out that the features disclosed in the context of at least one of the third, sixth and seventh embodiment may be preferably combined with the eighth aspect. It is also pointed out that one or more of the features disclosed in the context of at least one of FIGS. 11-16 and 27-28 may be preferably combined with the eighth aspect.

According to an ninth aspect, which can be combined with one or more of the previously mentioned aspects, there is provided a detergent drawer for a washing machine, the detergent drawer comprising a linear guiding, a first holder for a detergent container, a second holder for a front cover and a front cover arranged at the second holder, wherein the linear guiding provides a displacement of a movable portion of the detergent drawer relatively to the washing machine and at least approximately perpendicular to an operating panel of the washing machine in a direction of motion and wherein the detergent drawer has an driving mechanism configured to automatically close the detergent drawer using a mechanically generated force, when a user applies a pushing force to the front plate in an at least partially opened state of the detergent drawer.

Such detergent drawer may allow to omit a device that provides an electrically generated force, in particular an electric motor, for closing the detergent drawer. This may reduce manufacturing costs and improve the reliability of the driving mechanism.

In a refinement, the driving mechanism comprises the control mechanism described in the context of FIGS. 29-36.

BRIEF DESCRIPTION OF THE DRAWINGS

It is understood that the above-mentioned features and the features still to be explained hereafter are applicable not only in each stated combination, but also in other combinations or alone, without departing from the scope and spirit of the present invention.

Preferred embodiments are presented in more detail in the drawings and will be more closely explained in the description hereafter. The figures show.

DESCRIPTION OF PREFERRED EMBODIMENTS

Figure 1:
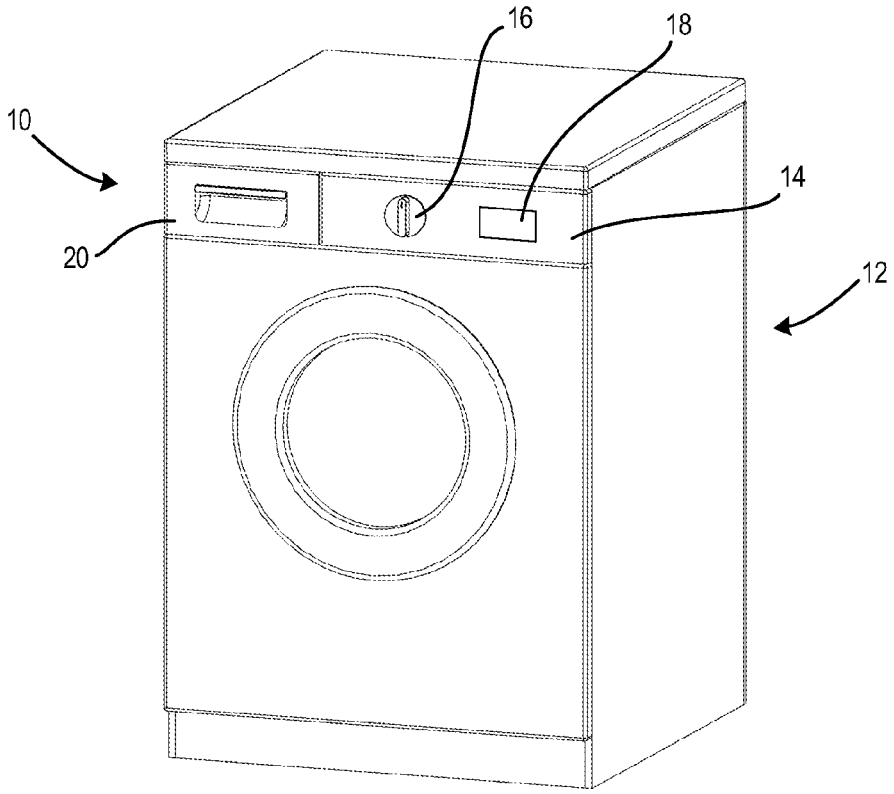
FIG. 1 a simplified representation of a washing machine.

FIG. 1 shows a detergent drawer 10 in a washing machine 12. The detergent drawer 10 is arranged next to an operating panel comprising a cover 14 that comprises a rotary switch and a display 18. In the representation shown here, only the shell-like handle 20 of the detergent drawer 10 can be seen.

Figure 2:
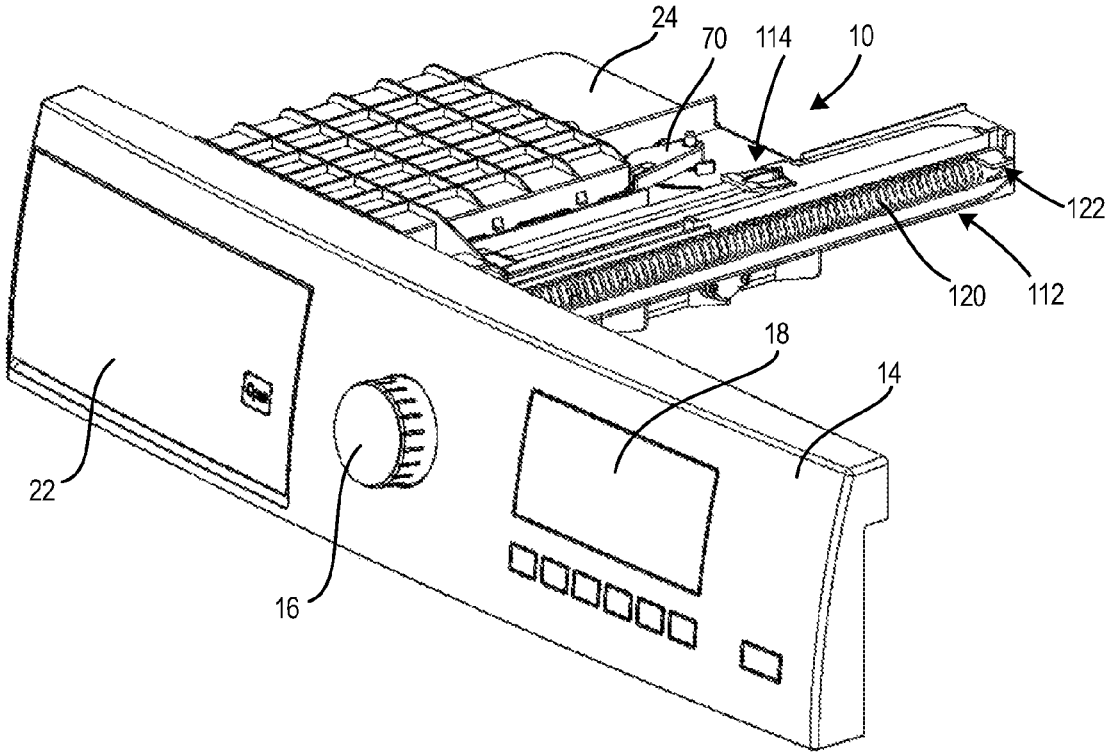
FIG. 2 a first embodiment of a detergent drawer in the closed state.

FIG. 2 shows a first embodiment of the detergent drawer 10, here with a front cover 22. It is noted that reference signs once introduced will retain their meaning in this and further figures. Furthermore, not necessarily all reference signs will be shown in each figure in the following figures for an improved overview. A housing part 24 is shown here that is configured to be fixedly connected to the washing machine 12. In other words, in the installed state the housing part 24 does not displace itself while opening or closing the detergent drawer 10. FIG. 2 also represents one exemplary embodiment related to the eighth aspect.

Figure 3:
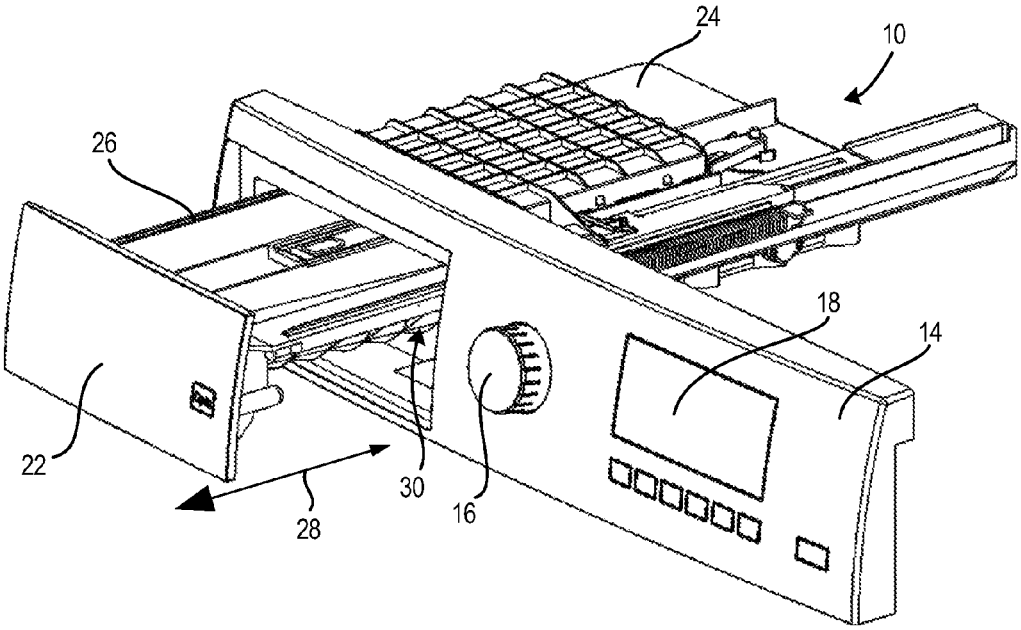
FIG. 3 the detergent drawer according to FIG. 2 in the open state.

FIG. 3 shows the detergent drawer 10 in the partially opened or opened state. It can be seen that the movable portion of the detergent drawer 10, here, only the front cover 22 and the detergent container 26 are shown, is guided linearly. This is achieved by means of a linear guiding 30 that is however largely hidden. The movement takes place along the direction of motion 28 that is indicated by a double-head arrow.

In the connection with the first embodiment it is pointed out that the features disclosed in the context of at least one of the fifth, sixth, seventh and eighth aspect may be preferably combined with the first embodiment. In the connection with the first embodiment it is pointed out that the features disclosed in the context of at least one of the third, sixth and seventh embodiment may be preferably combined with the first embodiment. In the connection with the first embodiment it is pointed out that one or more of the features disclosed in the context of at least one of FIGS. 11-16 and 27-36 may be preferably combined with the first embodiment.

It is to be pointed out that the double-head arrow here and in other figures has a large and a small head. The large head points in a direction of the closing direction or push-out direction or the drive-in direction, respectively, and the small head points in a direction of the opening direction or push-in direction or the drive-in direction, respectively. This serves for an improved orientation.

Figure 4:
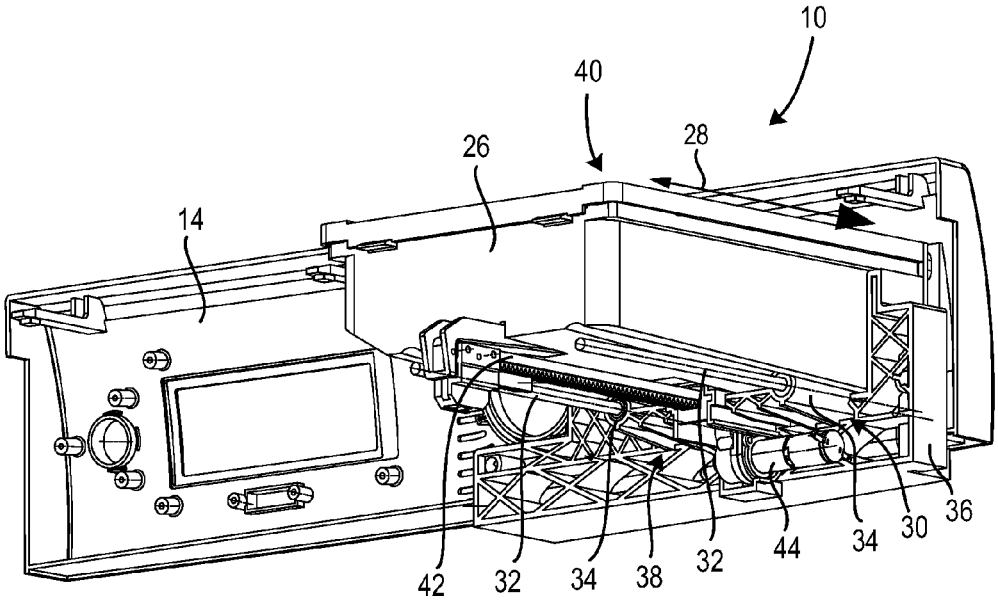
FIG. 4 a second embodiment of a detergent drawer in a view from back.

FIG. 4 shows a second embodiment of the detergent drawer 10, here in cooperation with a cover 14. The linear guiding 30 comprises a longish guiding element 32, here, in particular two guiding elements 32, that are each arranged in a guiding sleeve 34 and guided therein. The guiding sleeve 34 is configured to be fixedly connected with the washing machine 12, here it is arranged at a housing base 36. The guiding element 32 extends in the direction of motion 28 with a constant cross section. For the support of a filled detergent drawer 10, additional pre-tensioned rolling or sliding bearings can be provided.

The detergent drawer 10 further comprises furthermore a drive unit 38 that is configured to motorically move the movable portion 40 of the detergent drawer 10 into the direction of motion 28 or to support its motion. In this embodiment the drive unit 38 comprises a toothed rack 42 fixedly connected with the movable portion 40 of the detergent drawer 10 and a motor 44 with a gearwheel (not shown), wherein the gearwheel engages the toothed rack 42 and the motor 44 is configured to be fixedly connected to the washing machine 12. For this purpose, the motor comprises in particular a housing that is preferably fixed to the housing base 36.

In this embodiment the drive thus consists of an electronically controlled motor either with or without a gear. The connection of the drive motor 44 to the detergent drawer 10 is obtained by a toothed rack 42, which transmits the motor force via a gearwheel or a gear to the detergent drawer 10. The velocity, the force and/or the distance of the movement of the drawer is linearly adjustable by the electronic drive with internal or external determination of velocity, force and/or distance.

Figure 5:
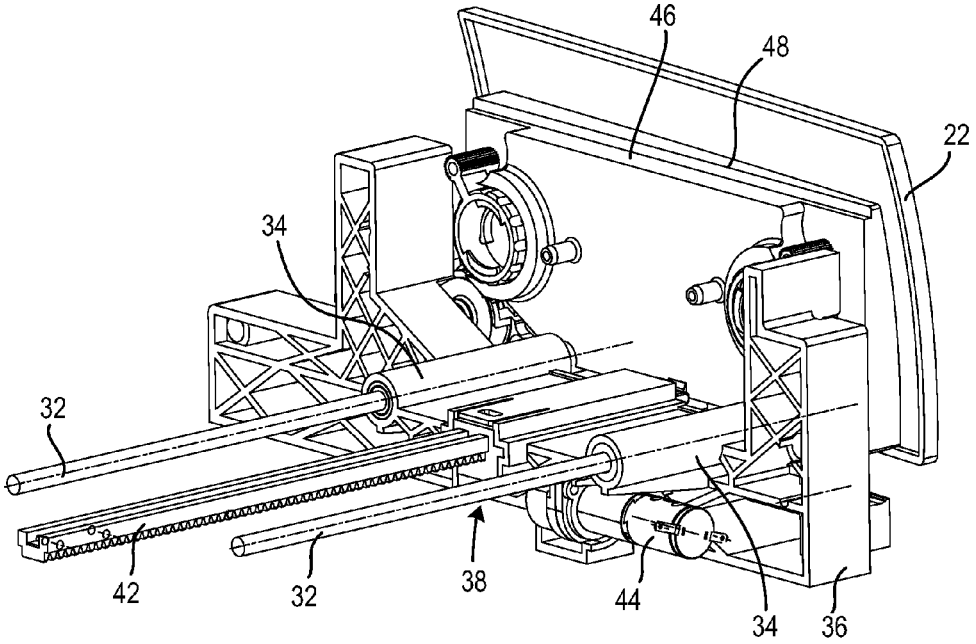
FIG. 5 a further representation of the detergent drawer according to FIG. 4, wherein the detergent container is removed.
Figure 6:
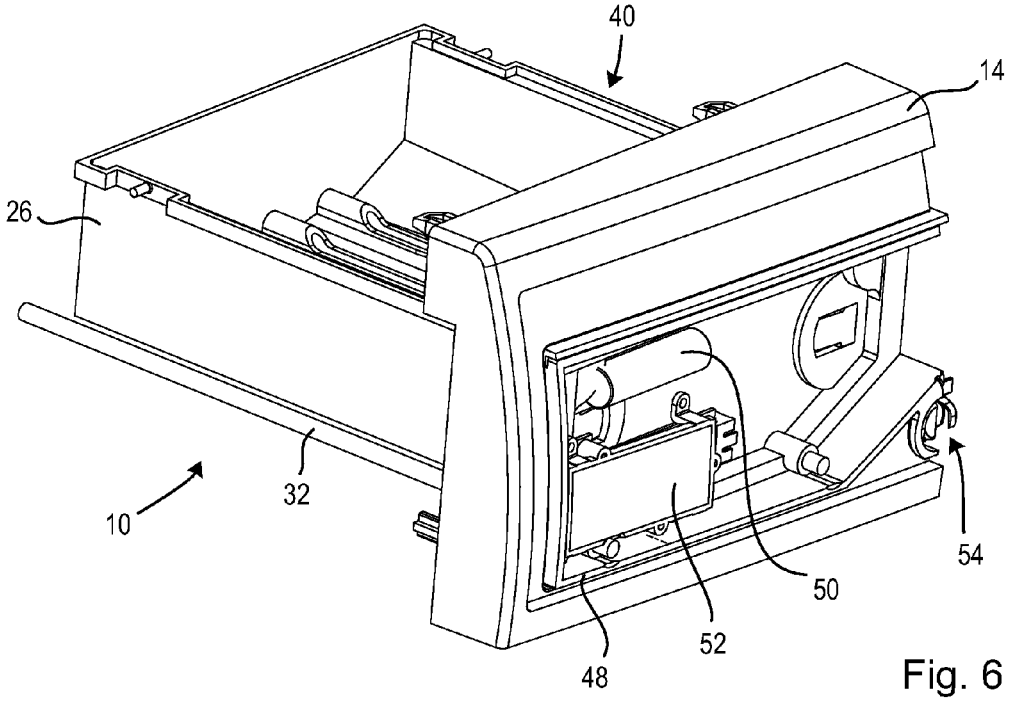
FIG. 6 a further representation of the embodiment according to FIG. 4 from the front.

The representation according to FIG. 5 shows an embodiment of a first holder 46 for the detergent container 26, which will be explained in more detail later. Further, the second holder 48 for the front cover 22 can be seen here. The first holder 46 and the second holder 48 are adjacent to each other and can be provided, also in particular, in one piece. FIG. 6 shows a view of the second embodiment in perspective from above from the front. An energy storage device 50 at a portion 40 of the detergent drawer 10 movable in direction of motion 28 and a two-piece transmission assembly 54 are shown. The energy storage device 50 serves as the lighting of display 52.

Figure 7:
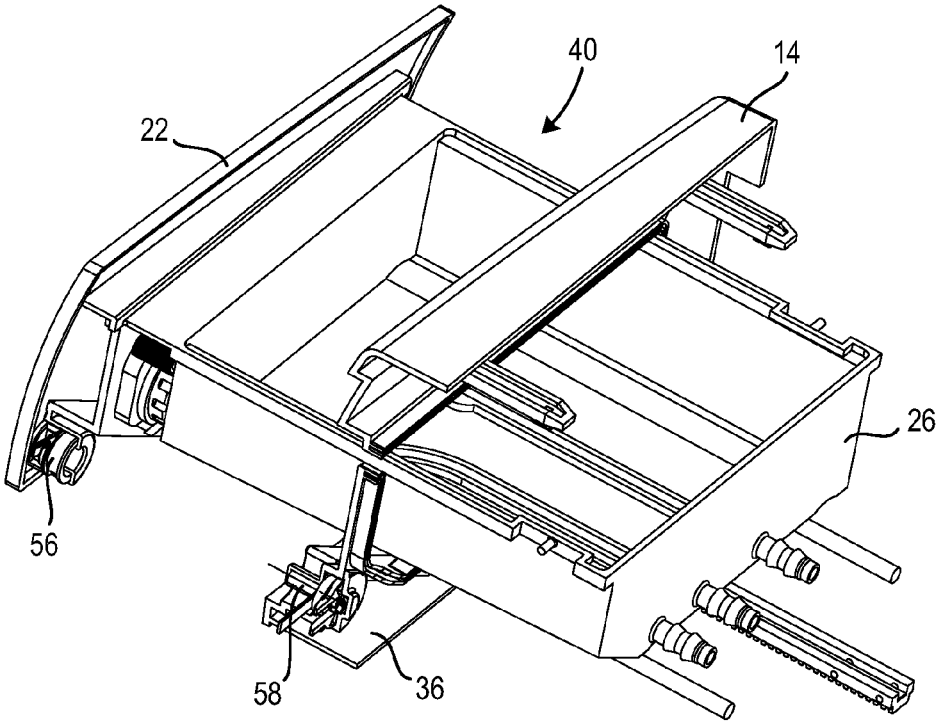
FIG. 7 a further representation of the detergent drawer according to FIG. 4 in the partially opened state.

FIG. 7 shows a further view of the second embodiment. It is shown that the two-piece transmission assembly group 54 comprises a first electric part 56 and second electric part 58. The parts 56, 58 are configured to transfer electric energy wirelessly from the first part 56 to the second part 58. The first electric part 56 is arranged at the detergent drawer 10, here at the movable portion 40 of the detergent drawer 10, and electrically connected to the energy storage device 50. The second electric part 58 is configured to be fixedly connected with the washing machine 12, in particular at the housing base 36. The first and the second part 56, 58 each comprise a coil.

In the shown position, the energy storage device 50 is decoupled from an energy supply provided by the second electric part 58.

Figure 8:
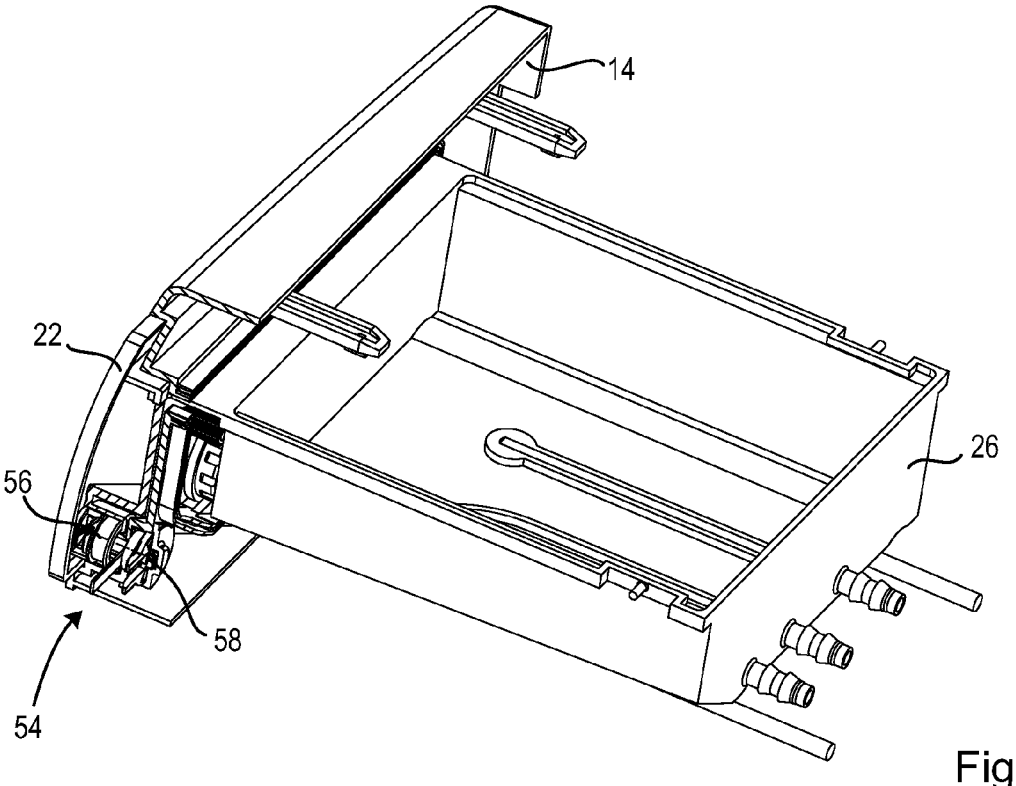
FIG. 8 a further representation of the detergent drawer according to FIG. 4 in the closed state.

FIG. 8 shows how the parts 56, 58 of the transmission assembly 54 engage each other in the closed or pushed-in state. Thereby the transfer of electric energy from the second electric part 58 to the first electric part 56 and thus to the energy storage device 50 is achieved.

Figure 9:
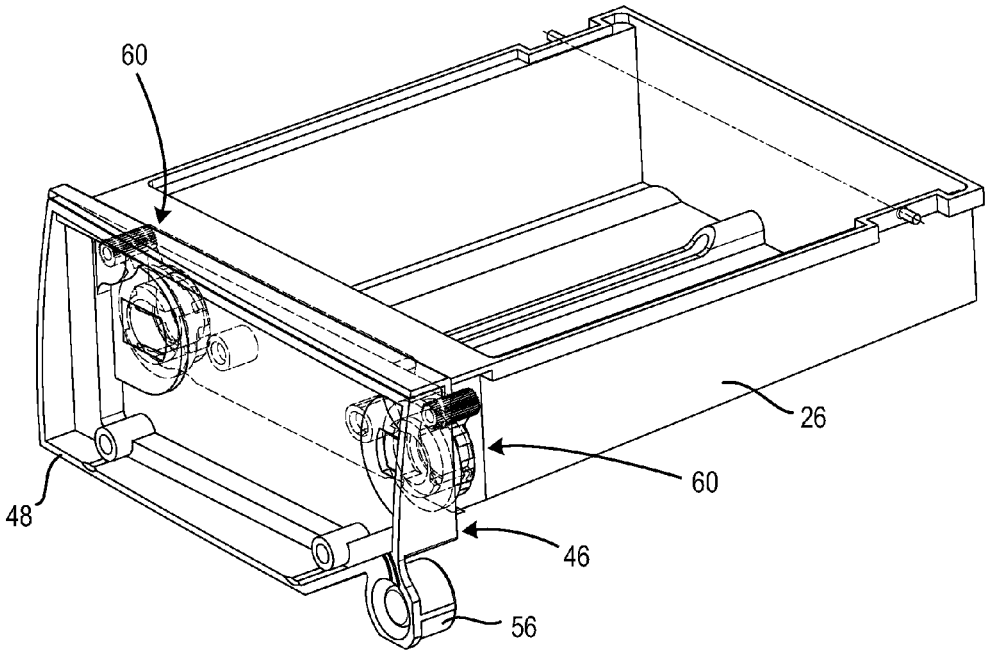
FIG. 9 a detailed representation of the detergent drawer according to FIG. 4.

FIG. 9 shows how the detergent container 26 is arranged at a first holder 46, here configured as one piece integral with the second holder 48. For this purpose, the detergent drawer 10 and the first holder 46 comprise a two-piece coupling assembly, here, two coupling assemblies 60. The coupling assemblies are configured to detachably and form-fittingly couple the detergent container 26 and the first holder 46 with each other. The coupling assembly 60 is configured at least similar to a bayonet connection.

Figure 10:
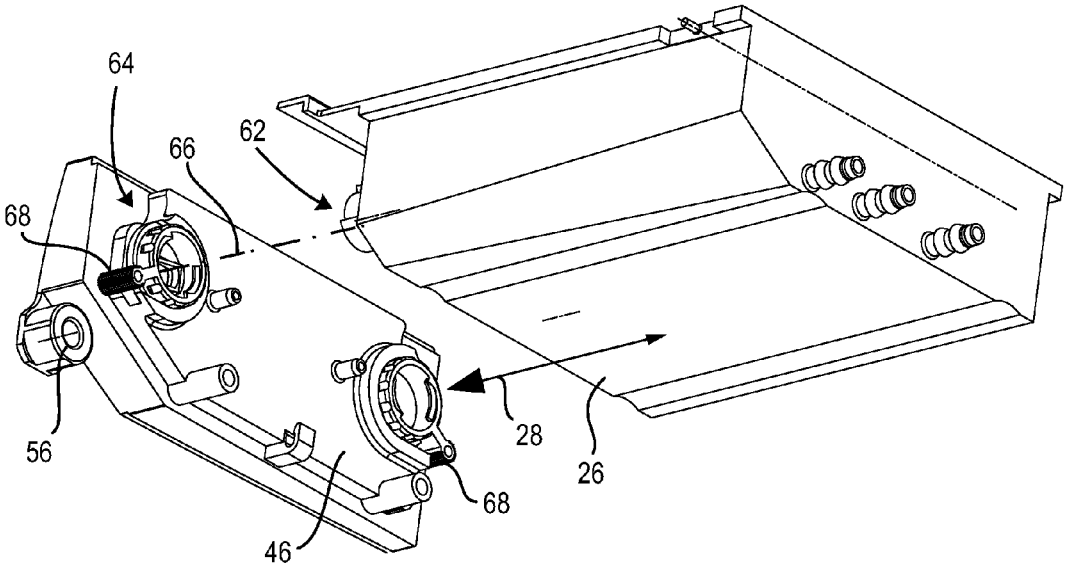
FIG. 10 a further detailed representation of the detergent drawer according to FIG. 4.

FIG. 10 illustrates the first portion 62 and the second portion 64 of the coupling assembly. The first portion 62 is arranged fixedly at the detergent container 26. The second portion 64 of the coupling assembly 60 is arranged at a first holder 46 and is rotatable around a rotational axis 66 along the direction of motion 28, in order to couple the first and the second portion with each other. The portions 62, 64 of the coupling assembly are formed so that in the coupled state a detaching between the first holder 46 and the detergent container 26 is prevented. Handle elements 68 enable a particularly easy rotating of each of the second portion 64.

In a particularly preferred embodiment it is provided that the energy storage device 50 and the associated electronic unit or the lighting unit, respectively, are completely integrated in a shell-like handle 20, in a front cover 22 or in a second holder 48. The lighting or display, respectively, works independently from whether the detergent drawer 10 is opened or closed. The embodiment furthermore allows for a water-proof and dust-proof encapsulation.

FIG. 3 shows a sectional portion of a third embodiment, in which the detergent drawer 10 comprises a housing part 24, at which a control lever 70 is arranged. The control lever 70 has preferably for stability reasons a cover plate that is not shown here for a better understanding some aspects of the invention. The control lever 70 has a sliding track 72 for a sliding control. A movable portion of the detergent drawer 10 comprises a sliding pin 74 that protrudes upwards from the drawing plane. The sliding pin 74 is configured to engage the sliding track 72 and to displace itself along the sliding track 72. The housing part 24 is also configured to be fixedly connected to the washing machine 12. The control lever 70 is rotatably arranged around a fixed rotation point 76 at the housing part 24.

The control lever 70 comprises a first section 78, a second section 80 and a third section 82. The sections 78, 80, 82 are designed so that the sliding pin 74 first reaches the first section 78 in a motion in direction of motion 28, then the second section 80 and finally the third section 82.

Figure 11:
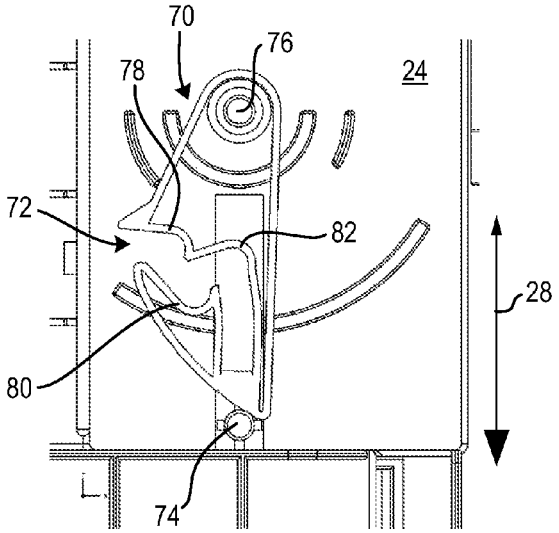
FIG. 11 a third embodiment of the detergent drawer with a control lever in a first position.

FIG. 11 shows the situation, when the detergent drawer 10 is pushed in and is about to reach its resting position in the closed state.

Figure 12:
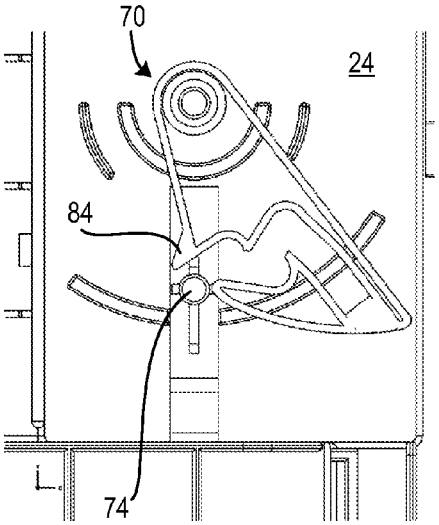
FIG. 12 the third embodiment of a detergent drawer with a control lever in a second position while closing the detergent drawer.

If the detergent drawer 10 is now to be pushed in further, i.e., referring to the drawing plane, the sliding pin 74 moves upwards, the control lever 70 is pressed to the side. The sliding pin 74 then reaches the first section 78, whose capture range is preferably enlarged by a protrusion 84. This is shown in FIG. 12.

Figure 13:
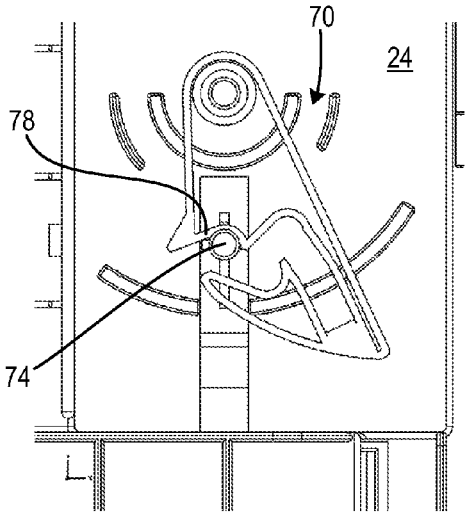
FIG. 13 the third embodiment of a detergent drawer with a control lever in a third position when closing the detergent drawer.
Figure 14:
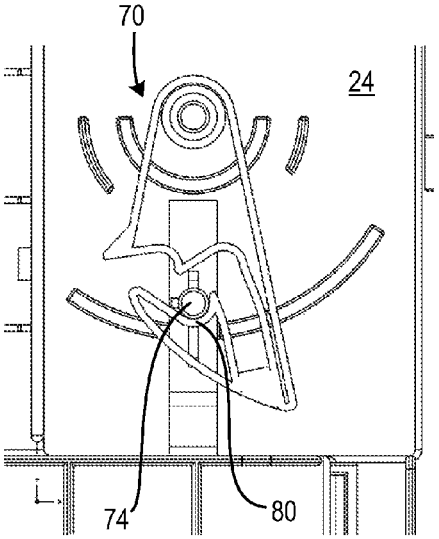
FIG. 14 the third embodiment of a detergent drawer with a control lever in a fourth position, when the detergent drawer is closed.

FIG. 13 shows that the sliding pin 74 has arrived at the end of the first section 78. If the sliding pin 74 now moves into the opposite direction, either by manual actuation or under the influence of a tensioning element or buffer element, the sliding pin 74 will be received by the second section 80 and comes to rest at the end of the second section 80, as it is shown in FIG. 14. Now the resting state of the detergent drawer 10 is reached in the closed state.

Figure 15:
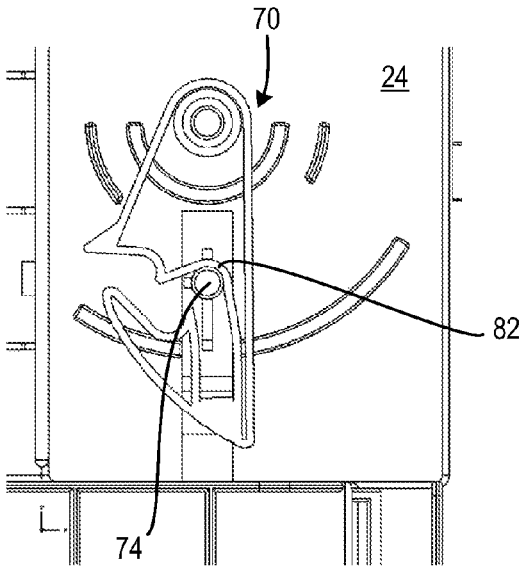
FIG. 15 the third embodiment of a detergent drawer with a control lever in a fifth position in the process of opening of the detergent drawer.

FIG. 15 shows that the detergent drawer 10, to be recognized by the sliding pin 74, was again displaced in the push-in direction. The sliding pin 74 has now been received by the third section 82.

Figure 16:
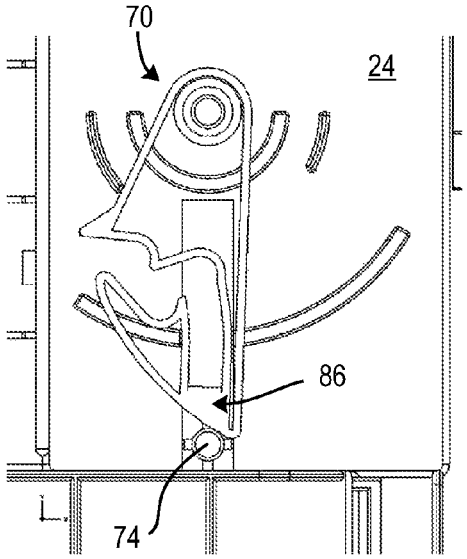
FIG. 16 the third embodiment of a detergent drawer with a control lever in a sixth position during the process of opening of the detergent drawer.

FIG. 16 shows the state, after the detergent drawer 10, again to be recognized by the sliding pin 74, was moved out compared to the previously shown position. The movement is preferably achieved by the previously mentioned actuating mechanism, preferably using the tensioning element 120 shown in FIGS. 27 and 28. The position according to FIG. 11 is reached again in this way.

In a section 86 the sliding track 72 comprises a level that is different from the level of the remaining sliding track 72. This provides for that the sliding pin 74 can move only unidirectionally along the sliding track 72 and does not go directly into the third section 82 when pushing in again, but moves again the control lever 70 to the side and moves to the first section 78.

Figure 17:
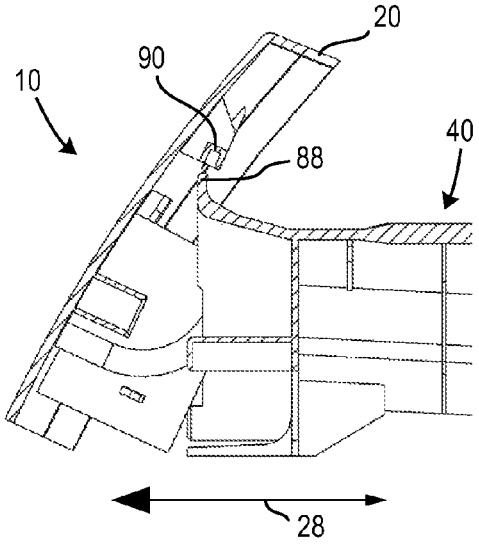
FIG. 17 a fourth embodiment before putting on a front cover.

FIG. 17 shows a fourth embodiment of the detergent drawer 10, that comprises a shell-like handle 20. The shell-like handle 20 is pivotable at the detergent drawer 10 around a pivoting point 88 at a part 40 of the detergent drawer 10 movable in direction of motion 28, when the shell-like handle is not yet interlocked with the detergent drawer 10. It is noted that the same arrangement can be provided for a front plate in general, in particular also for a front cover.

Figure 18:
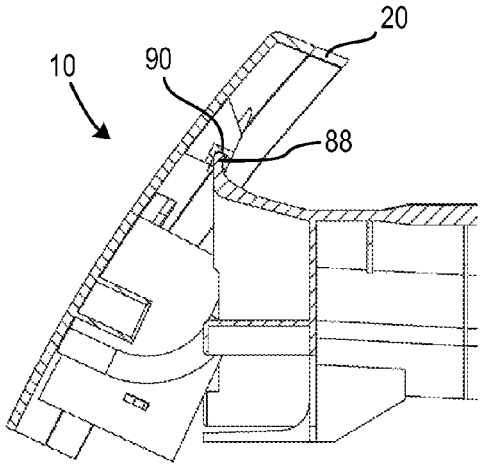
FIG. 18 the fourth embodiment according to FIG. 17 after putting on the front cover.

FIG. 18 shows the situation, when the shell-like handle 20 is placed onto the pivoting point 88 with the recess 90.

Figure 19:
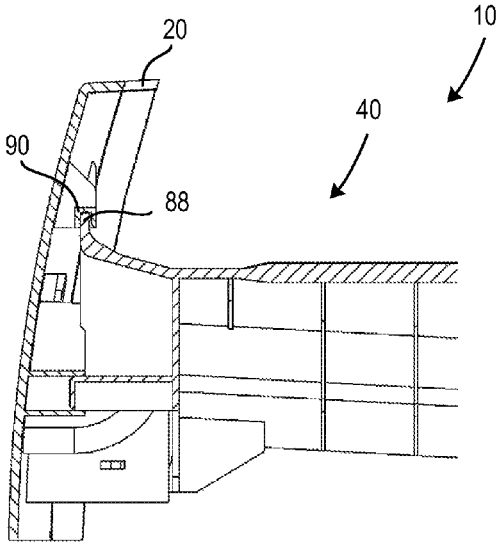
FIG. 19 the fourth embodiment according to FIG. 17 after interlocking the front cover.

FIG. 19 shows the situation, after the shell-like handle 20 was pivoted around a pivoting point 88 and is interlocked with the detergent drawer 10.

Figure 20:
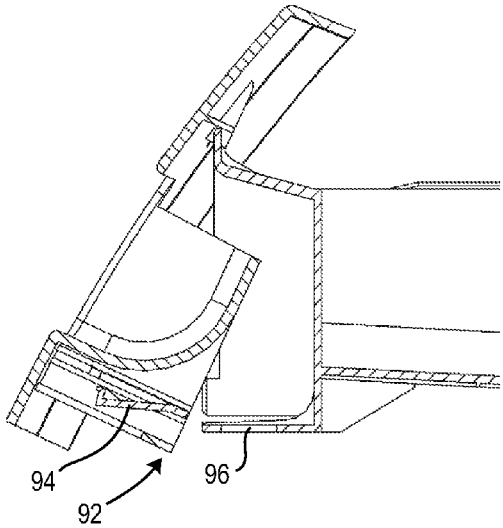
FIG. 20 a sectioning representation of FIG. 18.

FIG. 20 shows the situation according to FIG. 18 in cross section. There are provided an interlocking assembly 92 with a first interlocking part 94 that is configured as an interlocking nose that is configured to be resilient into the direction of the pivoting point 88, and a second interlocking part 96, which the first interlocking part 94 engages.

Figure 21:
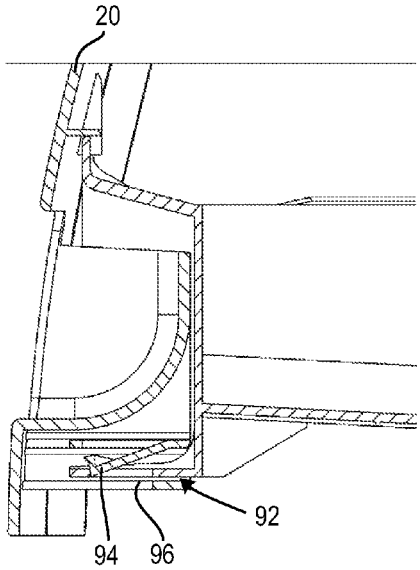
FIG. 21 a cutout of the sectioning representation of FIG. 19.

FIG. 21 shows a cutout of the sectioning representation according to FIG. 19, wherein the first interlocking part 94 is now interlocked with the second interlocking part 96.

Figure 22:
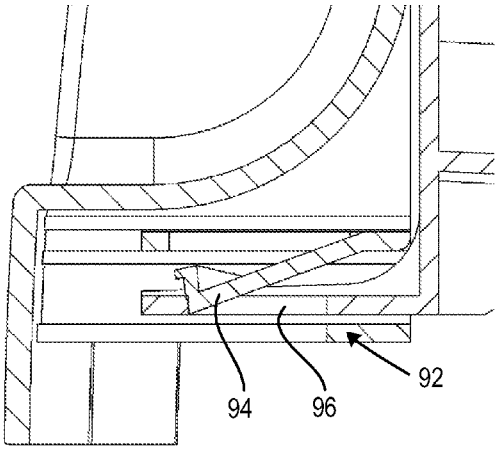
FIG. 22 a sectional magnification of FIG. 21.

FIG. 22 shows a magnified representation of the situation, when the interlocking assembly 92 is interlocked.

The provision of this central interlocking allows the user to easily take off the shell-like handle. For this purpose the user grasps the shell-like handle from below, presses the resilient first interlocking part 94 upwards, i.e. out of the second interlocking part 96, and can then take off the shell-like handle 20.

Figure 23:
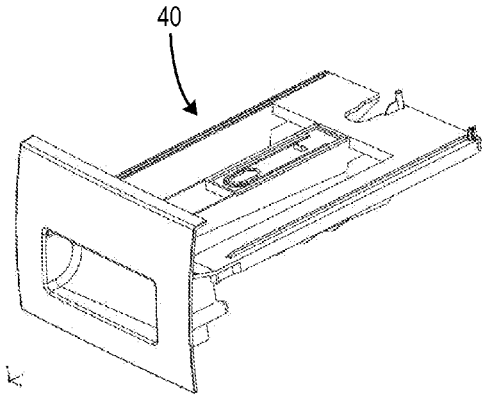
FIG. 23 the detergent container with a shell-like handle in the third embodiment in a perspective view from above.

FIG. 23 shows a view of the movable portion 40 of the detergent drawer 10 in perspective from above from the front.

Figure 24:
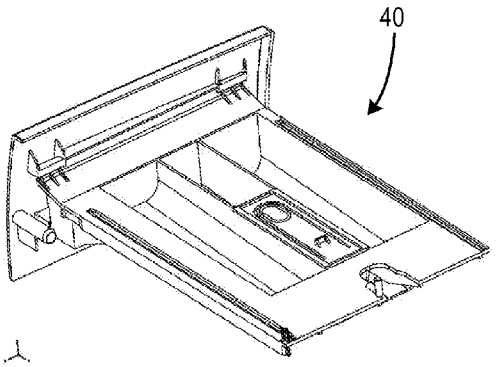
FIG. 24 the detergent container with the shell-like handle in the third embodiment in a perspective view from the back.

FIG. 24 shows a view of the movable portion 40 of the detergent drawer 10 in perspective from above from the back.

Figure 25:
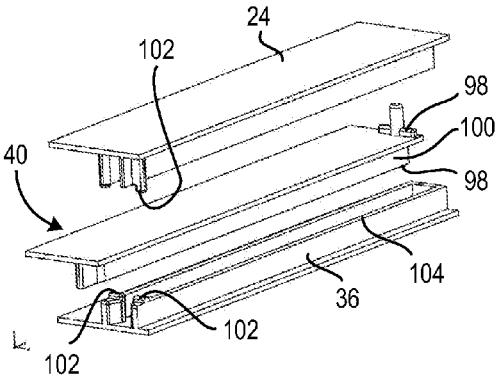
FIG. 25 a fifth embodiment of a detergent drawer with guiding rails in a perspective view from above.
Figure 26:
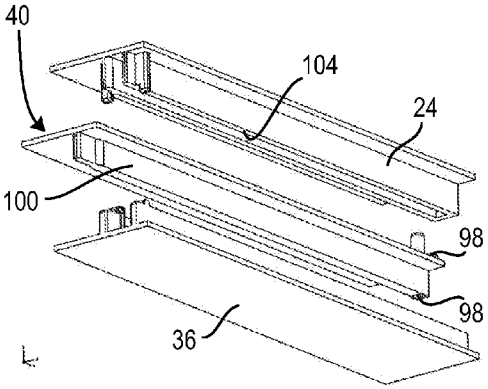
FIG. 26 the guiding rails of the fifth embodiment in an view in perspective from the back.

FIG. 25 shows a cutout through a fifth embodiment of a detergent drawer 10, namely a section of the housing part 24, a section of the movable portion 40 or of the detergent drawer 10, and a section of the housing base 36. It is shown that the bearing positions 98 are integrated horizontally and vertically into the movable portion 40 or the drawer, as well as the guiding rails 100. Further bearing positions 102 stay fixed horizontally and vertically in the housing parts 24, 36. Further, guiding grooves with bearing positions are integrated into the housing parts 24, 36. FIG. 26 shows the fifth embodiment from a different perspective.

Figure 27:
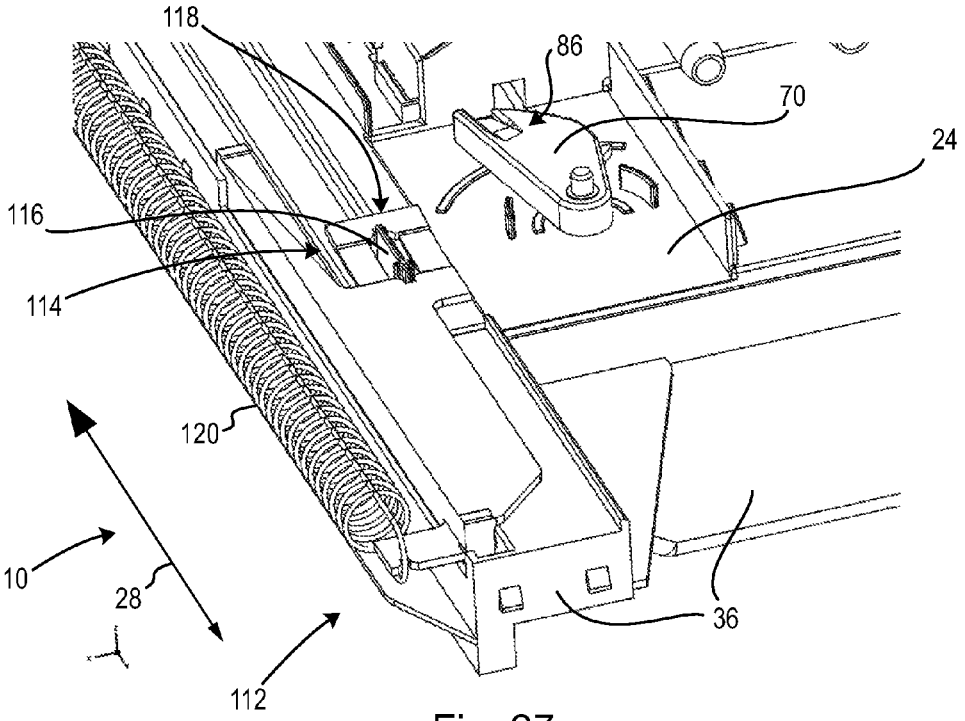
FIG. 27 a sixth embodiment of a detergent drawer with a locking element and a ramp area in the locked state.
Figure 28:
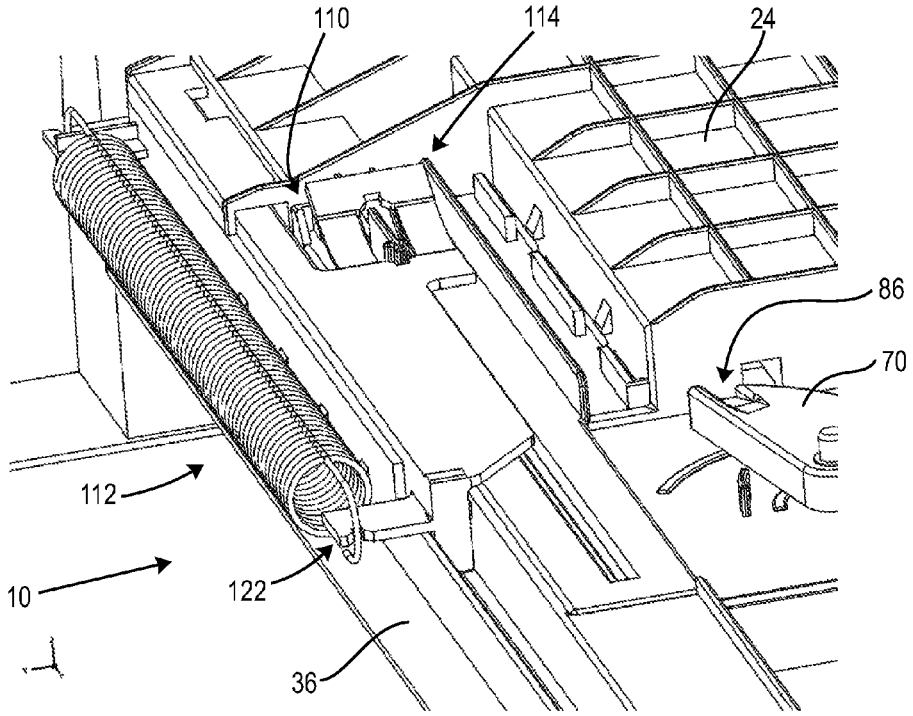
FIG. 28 the embodiment according to FIG. 27 in the unlocked state.

FIG. 27 shows a sixth embodiment of a detergent drawer 10 with a housing part 24, that has a ramp element 110 (see FIG. 28). The detergent drawer 10 further has an actuating mechanism 112 displaceable in direction of motion 28 and a locking element 114. The locking element 114 is configured to lock a portion 40 of the detergent drawer 10 movable relative to the housing part 24 with the actuating mechanism 112 and to detach it, when the locking element 114 slides onto the ramp element 110 while driving out the movable portion 40. It is noted that the actuating mechanism 112 is technically independent from the locking element 114, i.e. the actuating mechanism 112 can be embodied without the locking element 114 and vice versa.

The movable portion 40 of the detergent drawer 10 that is largely hidden here by the housing parts 24, 36, comprises a protrusion 116, that engages an opening 118 in the locking element 114.

The actuating mechanism 112 comprises a tensioning element 120, that is configured to provide a force in the direction of motion 28, here in the push-out direction, between the housing part 24 and the movable portion 40 in the tensioned state. A portion of the tensioning element 120 is arranged at a point 122 at the actuating mechanism 112. The housing part 24 is also configured to be fixedly connected to the washing machine 12.

FIG. 28 shows the situation, when the locking element 114 has slid onto the gliding element 110 when driving out the movable portion 40. It is shown that the locking element 114 has lifted itself at least on the side facing the push-out direction, so that the protrusion 116 is released and the movable portion 40 can be pulled out further. In particular, if the actuating mechanism 112 has moved the detergent drawer into an opened state, the user may now pull out the movable portion 40 further.

Figure 29:
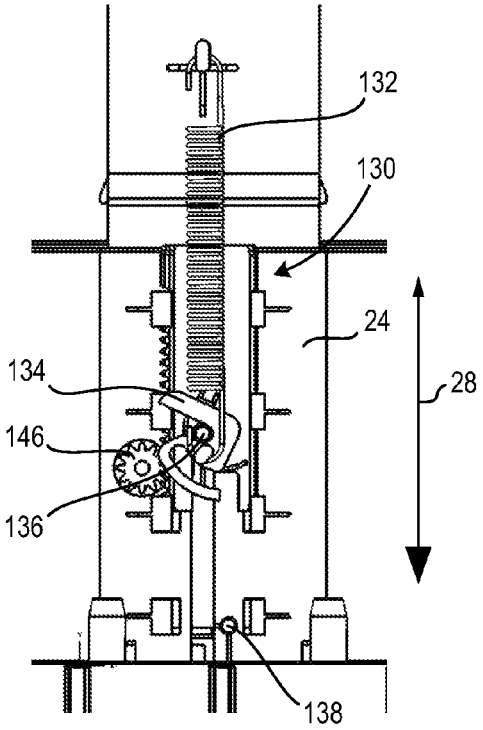
FIG. 29 a seventh embodiment of a detergent drawer with a locking lever in a first position in the closed state.

FIG. 29 shows a seventh embodiment of the detergent drawer 10, again with a housing part 24. Furthermore, a control mechanism 130 displaceable in direction of motion 28 and a tensioning element 132 is shown. The tensioning element 132 is preferably configured as a spring element and in particular as a pull-spring. The tensioning element 132 is configured to provide a force approximately into the direction of motion 28 between a housing part 24 and a part 40 of the detergent drawer 10 movable relatively to the housing part 24 in the tensioned state. The control mechanism 130 comprises a pivotable interlocking lever 134. The movable portion 40 comprises a guiding pin 136, and the housing part 24 comprises a locking pin 138.

The locking lever 134 has at least approximately an S-shape, wherein the guiding pin 136 is received by a first section 140 of the S-shape and the locking pin 138 is received by a second section 142 of the S-shape.

The locking lever 134 is configured and arranged so that the locking lever 134 receives in the guiding pin 136 in a first position along the direction of motion 28, and releases the guiding pin 136 and receives the locking pin 138 in a second position along the direction of motion 28. The housing part 24 is configured to be fixedly connected to the washing machine 12.

FIG. 29 shows the detergent drawer 10 in the closed or driven-in resting state.

Figure 30:
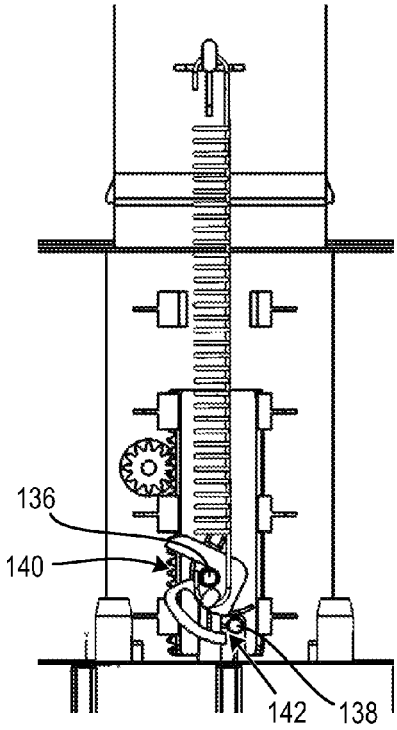
FIG. 30 the embodiment according to FIG. 29 in a second position in a opened or partially opened state.

FIG. 30 shows the situation, when the detergent drawer 10 was pulled out or moved out by the driving mechanism for a first distance and the control mechanism 130 arrives at the end of its way of motion. There are different possibilities for limiting the path of motion of the control mechanism 130 into the direction of motion 28. Here, an abutting of the control mechanism 130 at the locking pin 138 was chosen as an end stop.

Figure 31:
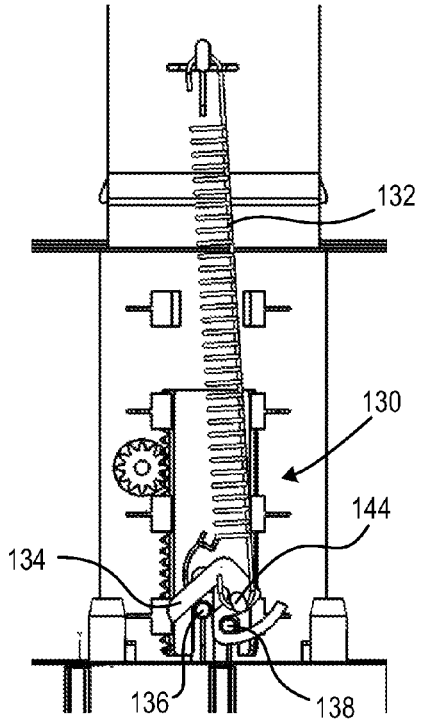
FIG. 31 the embodiment according to FIG. 29 in a third position, that is slightly further opened.

FIG. 31 shows the situation, when the detergent drawer 10, more precisely, the movable portion 40 of the detergent drawer 10, was pulled out or moved out a little bit further. Because the control mechanism 130 has arrived at the end of its path of motion, a pulling at the detergent drawer 10 now leads to a rotating of the locking lever 134, here in a counter-clockwise direction. Thereby the locking lever 134 releases the guiding pin 136 and receives the locking pin 138.

A portion of the tensioning element 132 is arranged at the steering point 144 at the locking lever 134 such that the steering point rotates around the guiding pin 136 and in this way displaces the steering point 144 at least approximately transversely to the direction of motion 128. This results in the locking lever 134 being kept in its position.

Figure 32:
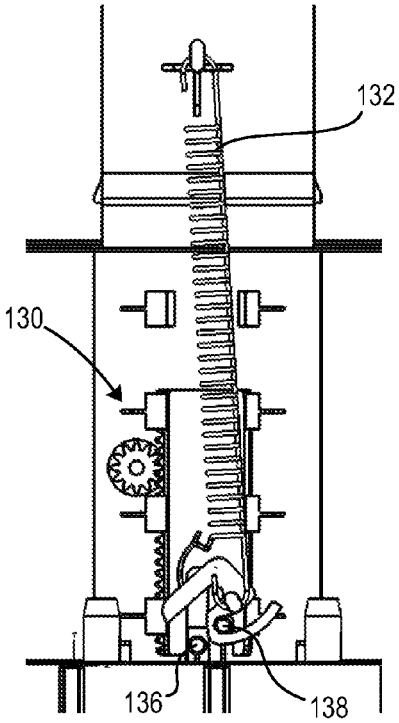
FIG. 32 the embodiment according to FIG. 29, in which the detergent drawer is again further opened when compared to FIG. 31.

FIG. 32 shows that the detergent drawer 10 can now be pulled out further without the locking lever 134 detaching itself. Overall, the control mechanism 130 remains in this position.

Figure 33:
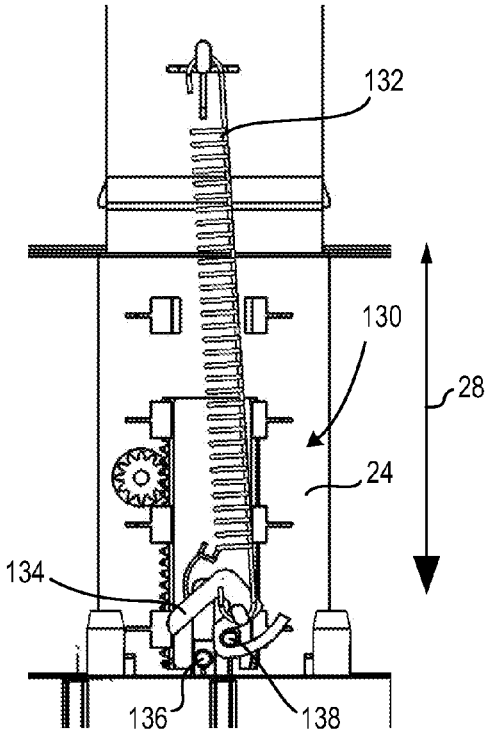
FIG. 33 the embodiment according to FIG. 29 in a fifth position, when the detergent drawer is opened.

FIG. 33 corresponds to FIG. 32 and shows the starting point for the following considerations, when the detergent drawer 10 is pushed in.

Figure 34:
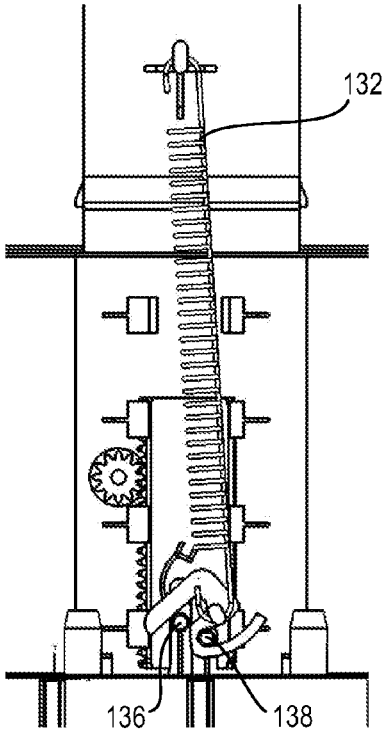
FIG. 34 the embodiment according to FIG. 29 in a sixth position, wherein the detergent drawer was slightly pushed in when compared to FIG. 33.

In FIG. 34 the guiding pin 136 reaches the first section 140 of the locking lever 134. The pressure against the locking lever 134 results in the locking lever 134 rotating now clockwise.

Figure 35:
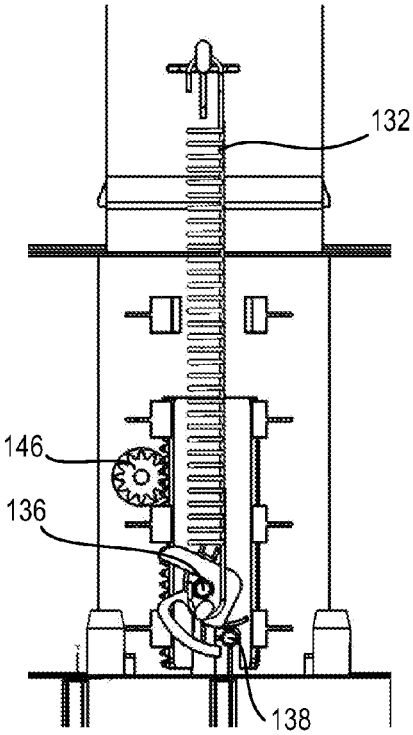
FIG. 35 the embodiment according to FIG. 29 in a seventh position, wherein the detergent drawer was further pushed in when compared to FIG. 34.

FIG. 35 shows the end of this rotation. The locking lever 134 is now detached and therefore also the control mechanism 130. Based on the tensioned tensioning element 132 the detergent drawer 10 is now autonomously pulled in. During this motion the drawer is slowed down by a rotary brake 146.

Figure 36:
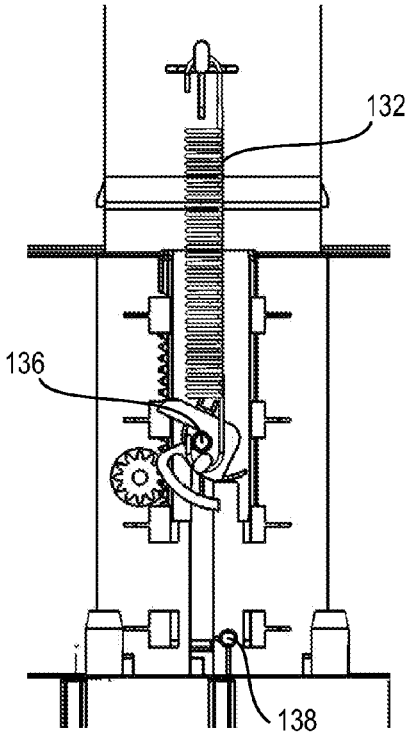
FIG. 36 the embodiment according to FIG. 29 in an eighth position, after the detergent drawer is closed.

FIG. 36 corresponds to FIG. 29 and shows again the resting state, when the detergent drawer is closed.

Combinations of the embodiments that comprise at least the features of the fifth and sixth embodiment or the fifth and seventh embodiment are viewed as particularly advantageous. Hereafter the particularities of a combination of fifth and seventh embodiment will be exemplarily described.

The guiding of the detergent drawer is improved and the horizontal and vertical slackness is minimized. The drawer is manually pulled out. After filling with detergent, the drawer is pushed for a short defined path and it then runs autonomously in a damped manner into its closed end position.

The improved horizontal and vertical guiding of the detergent drawer in the housing is achieved by separately arranged pairings of guiding ribs and guiding rails. The horizontal guiding of the drawer in the housing consists of a front and a back guiding pairing, is arranged at one side and corresponds to the fixed-floating bearing principle so that the large component tolerances of the drawer have no influence on the guiding. The guiding ribs and the guiding rails have small dimensions in cross section, which enables small tolerances and thus small gap dimensions and therefore a small slackness between the components in the manufacturing process (for example using injection molding).

The front horizontal guiding pairing between drawer and housing is fixedly arranged in the housing, while the back horizontal guiding pairing moves when pulling out the drawer. The vertical guiding is also arranged at one side of the drawer and receives a counter bearing on the opposite side. The front vertical guiding pairing between drawer and housing is fixedly arranged in the housing, while the back vertical guiding pairing moves with the drawer when pulling out the drawer. The guiding ribs and the guiding rails have small dimensions in cross section, which enables small tolerances and thus small gap dimensions and therefore a small slackness between the components in the manufacturing process (for example using injection molding).

When the drawer is pulled out, the smallest ratio of guiding length to guiding width is yielded by the smallest distance of the horizontal and vertical bearing positions. When closing the drawer the distance between the bearing positions increases and the horizontal and vertical overall slackness of the drawer is minimized.

When the drawer is completely pushed in the theoretically smallest overall slackness is present. Due to visual reasons the shell-like handle is typically positioned directly adjacent to the operating panel of the washing machine, in order to minimize the tolerance chains and to keep the gap dimensions between shell-like handle and operating panel small. This could mean that with a simultaneous engagement of all guiding elements between drawer and housing, shell-like handle and operating panel and a rigid connection between the shell-like handle and the drawer an over-determined system may result and the drawer jams. The over-determination of the system is avoided by, when closing the drawer and when the effect of the positioning elements between shell-like handle and operating panel comes into effect, the engagement of the front guiding elements between the drawer and the housing is released.

The closing of the drawer occurs through a mechanism, which pulls the drawer automatically into the end position. The closing mechanism consists of a spring element (mechanical, pneumatical or similar) connected with the housing and a capture apparatus. The capture apparatus is arranged shiftably at the housing and consists of a toothed rack with a rotatably arranged locking lever. The toothed rack cooperates with a rotary brake fixed to the housing, which damps the movement of the toothed rack. The connection of the closing mechanism to the drawer occurs via a pin at the drawer.

The working principle of the closing apparatus is as follows: The closed drawer is kept in the pulled-in position with the spring element by the locking lever. When pulling out the drawer, the spring element is tensioned. At the end of the tensioning path the spring is locked with the housing via a pin and kept under tension. Simultaneously, the locking lever releases the drawer, so that it remains in this position. Now the drawer can be filled with detergent or may be entirely removed for cleaning purposes. For closing, the filled or cleaned drawer is pushed over a short distance. Thereby the drawer is connected with the capture apparatus via the locking lever. Simultaneously, the connection with the housing is detached and the tensioned spring pulls the capture apparatus with the drawer into the closed end position.

The invention claimed is:

1. A detergent drawer for a washing machine, the detergent drawer comprising a linear guiding, a first holder for a detergent container, a second holder for a front plate, the front plate arranged at the second holder, wherein the linear guiding provides a displacement of a movable portion of the detergent drawer relative to the washing machine and at least approximately perpendicular to an operating panel of the washing machine in a direction of motion, wherein the detergent drawer has a driving mechanism configured to automatically open the detergent drawer using a mechanically generated force, when a user applies a pushing force to the front plate in a closed state of the detergent drawer and then releases the front plate, wherein the detergent drawer comprises a housing part, a control mechanism displaceable in the direction of motion and a tensioning element, wherein the tensioning element is configured to provide in the tensioned state a force approximately in the direction of motion between the housing part and a part of the detergent drawer moveable relative to the housing part, wherein:

the control mechanism comprises a pivotable locking lever, the moveable portion comprises a guiding pin, and the housing part comprises a locking pin, wherein the locking lever is configured and arranged such that the locking lever receives the guiding pin in a first position along the direction of motion, and pivots to both release the guiding pin, in a second position along the direction of motion, and receive the locking pin, wherein the housing part is configured to be fixedly connected with the washing machine.

2. The detergent drawer according to claim 1, wherein the detergent drawer comprises the housing part, at which a control lever is arranged, that comprises a sliding track for a sliding control, and the movable portion of the detergent drawer comprises a sliding pin, that is configured to engage the sliding track and to displace itself along the sliding track, wherein the housing part is configured to be fixedly connected with the washing machine.

3. The detergent drawer according to claim 2, wherein the sliding track comprises two different levels, that are configured to ensure an exclusively unidirectional motion of the sliding pin along the sliding track.

4. The detergent drawer according to claim 2, wherein the cooperation between the sliding pin and the sliding track is provided so that the sliding pin enters into the sliding track when moving the detergent drawer towards the closed state, rests in a curve of the sliding track in the closed state of the detergent drawer and blocks an opening of the detergent drawer, and exits from the sliding track when opening the detergent drawer.

5. The detergent drawer according to claim 1, wherein the detergent drawer comprises the housing part and an actuating mechanism displaceable in the direction of motion, wherein the actuating mechanism comprises the tensioning element, that is configured to provide a force into the direction of motion between the housing part and the movable portion in the tensioned state, a portion of the tensioning element is arranged at the actuating mechanism and the housing part is configured to be fixedly connected with the washing machine.

6. The detergent drawer according to claim 1, wherein the detergent drawer comprises the housing part, that has a ramp element, an actuating mechanism displaceable in the direction of motion and a locking element, wherein the locking element is configured to lock a portion of the detergent drawer movable relative to the housing part with the actuating mechanism and to detach it, when the locking element goes onto the ramp element when moving out the movable portion, wherein the actuating mechanism comprises a tensioning element, that is configured to provide a force into the direction of motion between the housing part and the movable portion in the tensioned state, a portion of the tensioning element is arranged at the actuating mechanism and the housing part is configured to be fixedly connected with the washing machine.

7. The detergent drawer according to claim 6, wherein the movable portion of the detergent drawer comprises a protrusion that can engage a recess in the locking element, and the recess is lifted when going onto the ramp element such that the protrusion is released.

8. The detergent drawer according to claim 1, wherein the locking lever has at least approximately an S-shape, wherein the guiding pin is received by a first portion of the S-shape and the locking pin is received by a second portion of the S-shape.

9. The detergent drawer according to claim 1, wherein a portion of the tensioning element is arranged at a steering point at the locking lever such that the steering point rotates around the guiding pin during the release of the guiding pin and thereby displaces the steering point approximately transversely to the direction of motion.

10. The detergent drawer according to claim 1, wherein the linear guiding comprises at least one guiding element, that is arranged in a guiding sleeve and being guided herein, wherein the guiding sleeve is configured to be fixedly connected to the washing machine.

11. The detergent drawer according to claim 10, wherein the detergent drawer comprises a drive unit, that is configured to drive by a motor the movable portion of the detergent drawer in the direction of motion or to support its motion.

12. The detergent drawer according to claim 11, wherein the drive unit comprises a toothed rack fixedly connected to the movable portion of the detergent drawer and the motor with a gearwheel, wherein the gearwheel engages the toothed rack and the motor is configured to be fixedly connected to the washing machine.

13. The detergent drawer according to claim 1, wherein the front plate is pivotable around a pivoting point at a portion of the detergent drawer movable in the direction of motion at the detergent drawer, when the front plate is not interlocked with the detergent drawer, wherein the detergent drawer comprises an interlocking assembly with a first interlocking part and a second interlocking part and the two interlocking parts are configured to interlock with each other, when front plate lies at least sectionally against the detergent drawer in a motion around the pivoting point.

14. The detergent drawer according to claim 13, wherein the first interlocking part is an interlocking nose, that is configured to be resilient in direction of the pivoting point, and the second interlocking part is a recess, which the first interlocking part engages.

* * * * *